US006551165B2

(12) United States Patent
Smirnov

(10) Patent No.: US 6,551,165 B2
(45) Date of Patent: Apr. 22, 2003

(54) INTERACTING TOYS

(76) Inventor: Alexander V Smirnov, 6038 Tyndall Ave., New York, NY (US) 10471

( * ) Notice: Subject to any disclaimer, the term of this patent is extended or adjusted under 35 U.S.C. 154(b) by 0 days.

(21) Appl. No.: 09/894,148

(22) Filed: Jun. 28, 2001

(65) Prior Publication Data

US 2002/0000062 A1 Jan. 3, 2002

Related U.S. Application Data

(60) Provisional application No. 60/215,702, filed on Jul. 1, 2000.

(51) Int. Cl.[7] ..... A63H 3/28
(52) U.S. Cl. ..... 446/175; 446/297
(58) Field of Search ..... 446/297, 298, 446/397, 401, 405, 301, 300, 299; 463/1, 35, 39, 36, 40, 30, 31, 9; 434/308, 307 R

(56) References Cited

U.S. PATENT DOCUMENTS

| | | | | |
|---|---|---|---|---|
| 4,221,927 A | | 9/1980 | Dankman et al. | 179/1 VC |
| 4,840,602 A | | 6/1989 | Rose | 446/175 |
| 4,857,030 A | | 8/1989 | Rose | 446/303 |
| 5,752,880 A | | 5/1998 | Gabai et al. | 463/303 |
| 6,110,000 A | * | 8/2000 | Ting | |
| 6,309,275 B1 | * | 10/2001 | Fong et al. | |
| 6,358,111 B1 | * | 3/2002 | Fong et al. | |
| 6,375,535 B1 | * | 4/2002 | Fong et al. | |

FOREIGN PATENT DOCUMENTS

| | | | |
|---|---|---|---|
| CA | 2225060 | 10/1998 | 446/297 |
| WO | WO 0015316 | 3/2000 | |

* cited by examiner

*Primary Examiner*—Jacob K. Ackun

(57) ABSTRACT

Each of interacting toys comprises a housing defining its form and outward appearance, means for transmitting messages with information about the first toy, means for receiving messages transmitted by the other toy with information about the second toy, means for reproducing reaction of the first toy to the second toy and to the user interaction, storage means containing data about reactions of the first toy to various other toys and to various user actions.

Each of interacting toys periodically sends messages about itself to another toy receives messages from it. If the first toy detects the presence of the second toy, it reacts to this fact for example by making a sound characterizing the reaction of the first toy to the second toy. The type of reaction and its intensity level depend on information received from the second toy. The seconds toy operates in the same way. Thus, the imitation of various relationships between toys and the variety of toys' behavior are provided.

19 Claims, 12 Drawing Sheets

32

| RType | RDeg | Subroutine address |
|---|---|---|
| 0 | 1 | Adr 1 |
| 0 | 2 | Adr 2 |
| . . . | . . . | . . . |
| 3 | 2 | Adr 11 |
| 3 | 1 | Adr 12 |

41

| |
|---|
| Sound Program 1 |
| Sound Program 2 |
| . . . |
| Sound Program 11 |
| Sound Program 12 |

42

Fig.4

34

| ID | Rb | Db | WR | WD |
|---|---|---|---|---|
| 014 | 3 | 2 | 110 | 200 |
| 018 | 2 | 2 | 150 | 300 |
| . . . | . . . | . . . | . . . | . . . |
| 738 | 0 | 1 | 0 | 150 |

Fig.5

35

| Size | Appear. | Rb | Db | WR | WD |
|---|---|---|---|---|---|
| 0 | 0 | 2 | 2 | 0 | 150 |
| 0 | 1 | 2 | 2 | 0 | 160 |
| 0 | 2 | 3 | 1 | 0 | 140 |
| . . . | . . . | . . . | . . . | . . . | . . . |
| 3 | 1 | 2 | 1 | 0 | 150 |
| 3 | 2 | 3 | 1 | 0 | 200 |
| 3 | 3 | 3 | 2 | 0 | 120 |

Fig.6

36

| NSens | Rb | Db | WR | WD |
|---|---|---|---|---|
| 1 | 3 | 1 | 130 | 150 |
| 2 | 2 | 1 | 120 | 150 |

Fig.7

INTERACTING TOYS

This application claims the benefit of Provisional Application Ser. No. 60/215,702 filed Jul. 1, 2000.

FIELD OF THE INVENTION

The invention relates to toys reacting to external actions, including signals transmitted by other toys.

BACKGROUND OF THE INVENTION

Toys relate to objects, which all people use. For children toys to a big extend determine the world around them, are a powerful means of development, up-bringing and education. For adults a toy can be a pleasant souvenir that entertains, helps to relieve stress, livens up the everyday routine or calls up memories.

Normally, toys are passive participants of interaction with the user, who using voice and imagination allots toys with speech and causes them to interact among themselves. For many years, we have known toys reacting to the activation by the user of their parts, for example, giving sounds when pressed. If toys are given an ability to interact to a certain extend independently with each other, thus, adding personality elements to each toy, letting them demonstrate emotions and respond to external actions and to other toys, the toy world will liven up, become more diverse and more instructive.

Voice-responsive "talking" toy is described in U.S. Pat. No. 4,221,927, to Dankman, et al, 1980. This invention discloses a toy, which in response to a complex sound such as human speech, generates a train of audio pulses. The pulses are psuedo-random with respect to frequency composition and to duration. The length of the pulse train is made random, too. Thus, the toy simulates syllabic speech. In this toy mouth motions are also simulated when sounds are pronounced.

This toy imitates speech interaction with a person. However, this toy can not form different sounds in reply to different effects, that is create simulation of different responses reflecting its personality.

A talking doll responsive to external signal is described in U.S. Pat. No. 4,840,602 to Rose, 1989. A remote source provides a narration and transmits a radio frequency signal providing binary coded data. The doll has a radio frequency receiver which receives encoded data from the remote signal source, a memory in which speech data is stored, a speech synthesizer and a central processing unit, which analyzes received data and accesses the memory for selected speech data to simulate the doll's response to portions of the narration from the remote signal source. Thus, either a conversation or a story told together with the doll is simulated.

U.S. Pat. No. 4,857,030 to Rose, 1987 exposes conversing dolls. Two or more dolls with speech synthesizing systems appear to intelligently converse while signaling each other via a radio frequency transmission to indicate what has been spoken, and to request a response which is intelligent with respect to the synthesized speech of the first doll. Additionally, the synthesized speech is made responsive to various positions of the doll or the actuation of certain sensors on the doll, or even the motion of the doll. The choice of a program defining the contents of conversation between dolls is every time carried out as a random selection from several programs.

The last two inventions have certain limitations. All dolls that participate in a conversation have identical programs.

Every time roles are given to the dolls by a random selection. Therefore, it is not possible to give any doll a permanent role or personality. Further, the interactions among dolls will be identical if we take, for example, different combinations of two dolls out of three available. Therefore, the possibilities to diversify the game with such dolls are rather restricted.

There is also an interactive doll shown in U.S. Pat. No. 5,752,880 to Gabai et al, 1998. In this patent apparatus for a wireless computer controlled toy system is disclosed. The invention allows the user "to converse" with dolls. The phrases pronounced by the user are perceived by the device located in a doll and are broadcast to the computer, which will recognize these phrases, select answering phrases, synthesize speech and transmit it via radio back to the device inside the doll, that plays back answers. This patent also points out the possibility of interaction among dolls in such system.

However, this invention also has its limitations. The use of the computer makes the system expensive and complicated. Each doll taken separately is passive and can not reproduce any response without a link to the computer. The introduction of new dolls into the system requires execution of a series of operations with the control program on the computer, the task too difficult for the majority of users, especially for children.

U.S. Pat. No. 6,110,000 to Ting, 2000, discloses a doll set with unidirectional infrared communication for simulating conversation. One doll out of said doll set comprises an infrared signal transmitter, and another—a receiver. Both dolls comprise a means for reproducing sound signals or other actions. A first doll executes various actions according to the program therein and transmits data that determines responses of a second doll. Thus, the set imitates the interaction of two dolls, for example of their conversation.

The dolls according to U.S. Pat. No. 6,110,000 execute interaction programs prerecorded for each pair of doll. The first doll always reproduces the same phrases regardless what exact doll is in front of it or if there is any. This significantly limits possibilities for imitating the interaction between two toys.

U.S. Pat. No. 6,309,275 to Fong, et al., 2001, discloses interactive talking dolls, wherein each of the dolls comprises means for reproducing sound signals, for example fragments of speech, transmitter and receiver of infrared signals, control means, and a switch or a receiver of the remote control signal for activation. Upon activation, the toy performs a desired action, such as the enunciation of a speech pattern, and signals another toy to perform a responsive action. In this way the interaction between two toys is achieved.

Dolls according to U.S. Pat. No. 6,309,275 execute prerecorded interaction programs. The interaction is possible only if their memories comprise a recording of the interaction program for the given pair of dolls. This limits the expansion of toy sets by a simple introduction of new toys.

The same limitation applies to the interactive talking dolls according to U.S. Pat. No. 6,358,111 to Fong, et al., 2002, and U.S. Pat. No. 6,375,535 to Fong, et al., 2002.

OBJECTS AND SUMMARY OF THE INVENTION

It is the object of the present invention to provide interacting toys, each of which can transmit information about itself to other toys and receive information transmitted by other toys, and to respond to other toys according to the received information about other toys, so that responses of toys to each other imitate their mutual sympathy, antipathy and other interpersonal mutual relations.

Another object of the present invention is to provide interacting toys, each of which differently responds to other toys and to the activation by the user so that responses of toys imitate personalities and temperaments of characters represented by them, and mutual relations among these characters.

The further object of the present invention is to provide interacting toys, each of which will have the individuality so that even two toys of one type will have different behavior when interacting among themselves and with other toys, and also when affected by the user.

The next object of the present invention is to provide interacting toys that enable the user to add new toys to the existing toy community, thus getting new variants of behavior and mutual relations among toys.

The further object of the present invention is to provide interacting toys, the response of each of which to other toys and to the activation by the user imitates different emotional conditions of the personality represented by this toy and can have different degrees or intensities corresponding to degrees of an emotional condition.

The further object of the present invention is to provide interacting toys, the response of each of which gradually fades after the user terminates his/her activation and after other toys of the type are removed, and the time required for the response to fade can be preset differently for different toys to imitate personality features of characters represented by the toys.

The further object of the present invention is to provide interacting toys, which responses to other toys and the activation by the user to some extent depend on a random factor so that to make behavior of toys more diverse and to make playing with them more interesting.

The further object of the present invention is to provide interacting toys, which will form an open system that will give toy manufacturers a possibility to produce new toys, interacting among themselves, as well as with toys manufactured before, and add more and more new characters to the toy sets available on the market, thus, supporting interest of consumers to the product line.

The further object of the present invention is to provide interacting toys, the information exchange between which would be ensured by simple and cheap means to keep costs to the minimum.

The further object of the present invention is to provide interacting toys, in which different characters and different responses would be ensured by maximal unification of its circuits to reduce production costs of a great number of toy groups.

These and other objects of the invention are achieved in interacting toys, the description of which will be given below.

Interacting toys consist of a first toy and a second toy. The first toy contains a housing defining its shape and appearance, means for transmitting of messages containing information about this first toy, means for receiving of messages transmitted by the second toy and containing information about the second toy, means for reproduction of responses of the first toy to the second toy and to the activation by the user, storage means containing data about responses of the first toy to different second toys and to different types of the activation by the user. The second toy has the similar structure.

The first toy periodically sends messages about itself to the second toy and receives messages from the second toy. If the first toy detects the presence of the second toy, it responds to this fact, for example, by producing sounds that characterize the response of the first toy to the second toy. A type of response and degree of its intensity are determined by the information received from the second toy. The second toy operates similarly. Thus, simulation of different mutual relations between toys and the range of toys behavior models are provided.

Other objects, features and advantages of the invention shall become apparent as the description thereof proceeds when considered in connection with accompanying drawings.

BRIEF DESCRIPTION OF THE DRAWINGS

FIG. 4 shows a structure of Sound Responses area in ROM;

FIG. 5 shows a parameter table Id-LUT for determination of a response to the presence of the known toy;

FIG. 6 shows a parameter table OP-LUT for determination of a response to the presence of an unknown toy;

FIG. 7 shows a parameter table Eff-LUT for determination of a response to an external action;

DETAILED DESCRIPTION OF THE INVENTION

In the beginning we will provide the general principles of interacting toys structure and operation.

Figure 1:
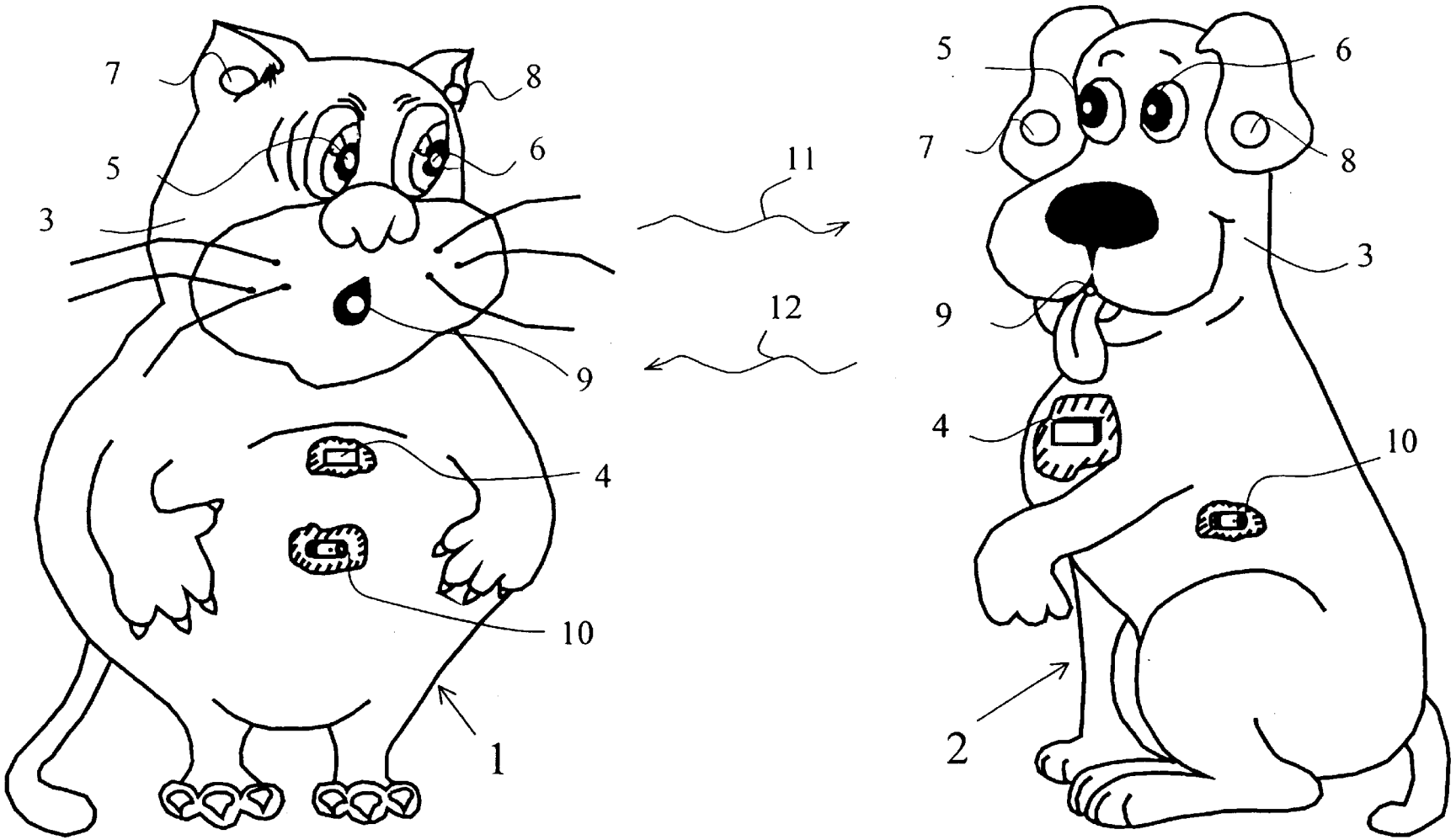
FIG. 1 shows two interacting toys and the structure of each of them.

FIG. 1 shows the first toy 1 and the second toy 2, that interact with one another. Each of toys 1, 2 can have appearance of a doll, fantastic character, real or fantastic animal, or an object. Each of toys 1, 2 has housing 3. Inside housing 3 of each toy there are electronic block 4, photoreceptor 5, and light-emitting diode 6. In different parts of toys 1 and 2 sensors 7 and 8 are placed. In appropriate places of housing 3 there are speaker 9 and supply unit 10.

Photoreceptor 5 is a regular photodiode of a short-wave infrared (IR) range. Light-emitting diode 6 also radiates in a short-wave IR range. Mini switches can be used as sensors 7 and 8. The switches are locked when pressed and are unlocked when the pressure is terminated. Supply unit 10 can contain one or several batteries. In the preferred embodiment of the present invention, each of toys 1 and 2 taken separately responds to the user activation realized as pressing sensors 7 and 8. Responses of each of toys 1, 2 are sounds synthesized in electronic block 4 and played back through speaker 9.

The first toy 1 sends message 11, which contains information about the first toy 1. The second toy 2 sends message 12, which contains information about the second toy 2. In each toy the sent message is generated in the form of an electrical signal by electronic block 4 and is radiated in the form of modulated IR radiation by light-emitting diode 6. Each of toys 1, 2 receives messages transmitted by another toy with the help of photoreceptor 5. The received message is decoded in electronic block 4.

Having received message 12 from the second toy 2 and having selected information about the second toy 2 from message 12, the first toy 1 reacts to the presence of the second toy 2 by reproduction of a sound response, which imitates an emotional response of the first toy 1 when meeting the second toy 2. Similarly, the second toy 2, having received message 11 from the first toy 1 and having selected information about the first toy 1 from message 11, reacts to the presence of toy 1 by reproduction of a corresponding sound response.

Sound responses played back by each of toys 1, 2 correspond to the appearance of the toy. For example, bears can growl, cats can mew and purr, a fantastic animal can give extraordinary fantastic sounds. It is also possible to synthesize sounds that would resemble elements of human speech—simple words and interjections.

Each of toys 1, 2 has several types of responses corresponding to different emotional conditions of the character represented by this toy. The type of response is further denoted as RType. In the preferred embodiment of the present invention RType can receive four values: 3—Joy, 2—Sadness, 1—Anger, and 0—Fear. There is a reference sound that corresponds to each condition. For example, a toy dog can express its joy by sounds imitating cheerful barking, its sadness—by whining, its anger—by roaring or angry barking; it expresses its fear by growling that goes into whining. Common notions can serve a base for selecting sounds or voice messages that characterize different emotional states of any toy. Each type of response has several degrees. The value of response degree is further designated RDeg. In the preferred embodiment of the present invention, RDeg can receive four values: 0, 1, 2, 3. RDeg=0 corresponds to a neutral state, which is identical for all emotional conditions. RDeg=1 corresponds to minimal level of an emotion, RDeg=2 corresponds to a medium level, and RDeg=3—to a maximal emotion level. Synthesized sounds depend on a degree of response. For different toys these dependencies can be expressed as a change of volume level, of content frequency, of intervals between repetitions of synthesized sound patterns, etc. The character of the sound can also change, for example from growling to loud barking when expressing anger in case of the above-mentioned toy dog.

The response of toy 1 or 2 taken separately to the activation by the user is determined by the character represented by this toy, and by which of sensors 7 and 8 the user has activated. During the interaction of two toys 1 and 2 responses of each of them depend on the fact, what toy exactly is its partner. In all cases the type and degree of response can have a random component. For example, when Winnie-the-Pooh meets Mickey Mouse, both toys can express mutual moderate joy. But when Mickey Mouse meets Cat Basilio, Mickey will be slightly frightened and the Cat will react by demonstrating anger.

The response of each of interacting toys 1, 2 gradually fades after removal of the other toy, that is value RDeg gradually decreases. The response of toy 1 or 2 taken separately gradually fades after the user stops activation of sensor 7 or 8. The rate of response fading depends on properties of the toy, that imitate temperament of the character represented by this toy. Later, after complete fading of a response, that is after value RDeg becomes equal to zero, electronic block 4 goes to Power Down Mode, when power consumption from power supply 10 becomes very low. To activate the toy the user has to press sensors 7 and 8 simultaneously. Further, we will procede to the detailed description of the preferred embodiment of the present invention.

Figure 2:
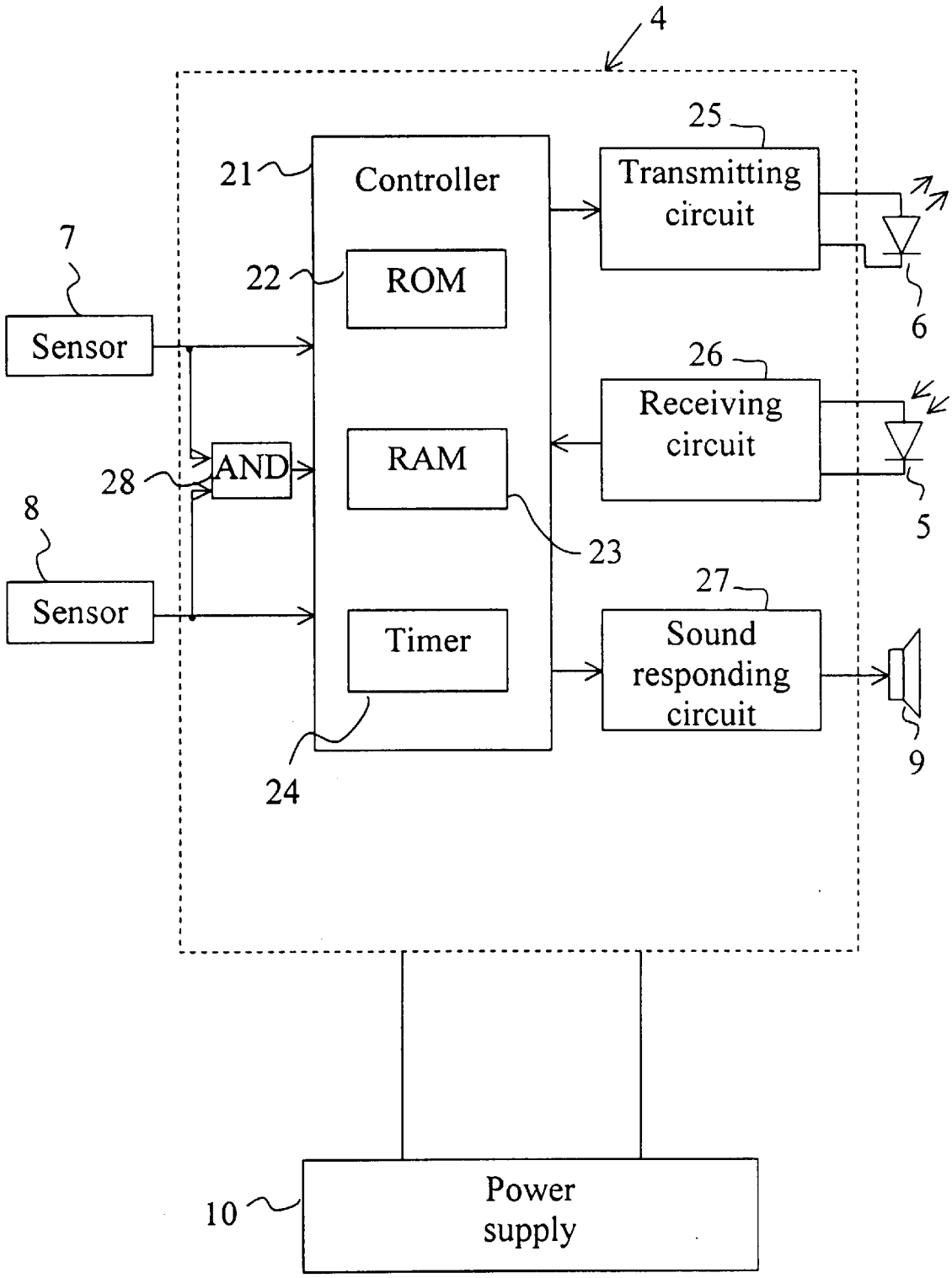
FIG. 2 shows an electrical structural circuit of a toy.

As shown in FIG. 2, electronic block 4 contains controller 21 comprising Read-Only Memory (ROM) 22, Random Access Memory (RAM) 23 and timer 24. One of the outputs of controller 21 is coupled with transmitting circuit 25, to the outputs of which light-emitting diode 6 is attached. One of the inputs of controller 21 is connected to the output of receiving circuit 26, to inputs of which photoreceptor 5 is attached. Another output of controller 21 is connected with sound reproducing circuit 27, an output of which is connected to speaker 9. Sensors 7 and 8 are attached to other inputs of controller 21. Sensors 7 and 8 are also attached to inputs of logic gate AND 28, the output of which is connected with Reset input of controller 21. Power is supplied from supply unit 10 to electronic block 4.

Microprocessor AT89C52 by Atmel Inc., U.S.A, that has 8 Kbytes ROM 22, 256 bytes RAM 23 and programmed timer 24 can be used as controller 21. Timer 24 can serve to interrupt the running of the program. The particular bits of input/output ports of controller 21 fulfil the functions of its inputs and outputs in the described embodiment of the invention. Controller 21 realized on the above-mentioned microprocessor has Power Down Mode, wherein power consumption is minimum. Controller 21 exits Power Down Mode, when signals simultaneously from both sensors 7, 8 are sent through logic gate AND 28 to Reset input of controller 21.

Transmitting circuit 25 contains a transistor switch and a resistor for forming current pulses through light-emitting diode 6. Receiving circuit 26 contains a preamplifier, a filter and a comparator. Such circuits are well known in the art. Sound reproducing circuit 27 contains a digital-to-analog converter (DAC) and an amplifier, which can be implemented on any appropriate integrated circuit.

Controller 21 executes the program recorded in ROM 22. To do so, it interrogates sensors 7, 8 and receiving circuit 26, sends data to sound reproducing circuit 27 for forming sound responses depending on the type of the activation by the user and on signals received from other toys, and sends data to transmitting circuit 25 for a message transmission. The program run on controller 21 will be described in detail later. During operation of the device, data received through receiving circuit 26 and variables used by the program are stored in RAM 23. Timer 24 periodically interrupts execution of the main program to run a subroutine of transmitting a message through transmitting circuit 25 and light-emitting diode 6.

Each message 11 transmitted by the first toy 1 contains a starting part, which allows electronic block 4 in the second toy 2 to detect the beginning of the message and to begin its reception, and parameters identifying the first toy 1. Each message 12 transmitted by the second toy 2 has the same structure. Messages format and method of transmitted parameters coding can be the same as in the widely known IR remote-control units. For example, different duration of pulse-to-pulse spacings of IR radiation can correspond to logic zeros and logic unites.

Figure 3:
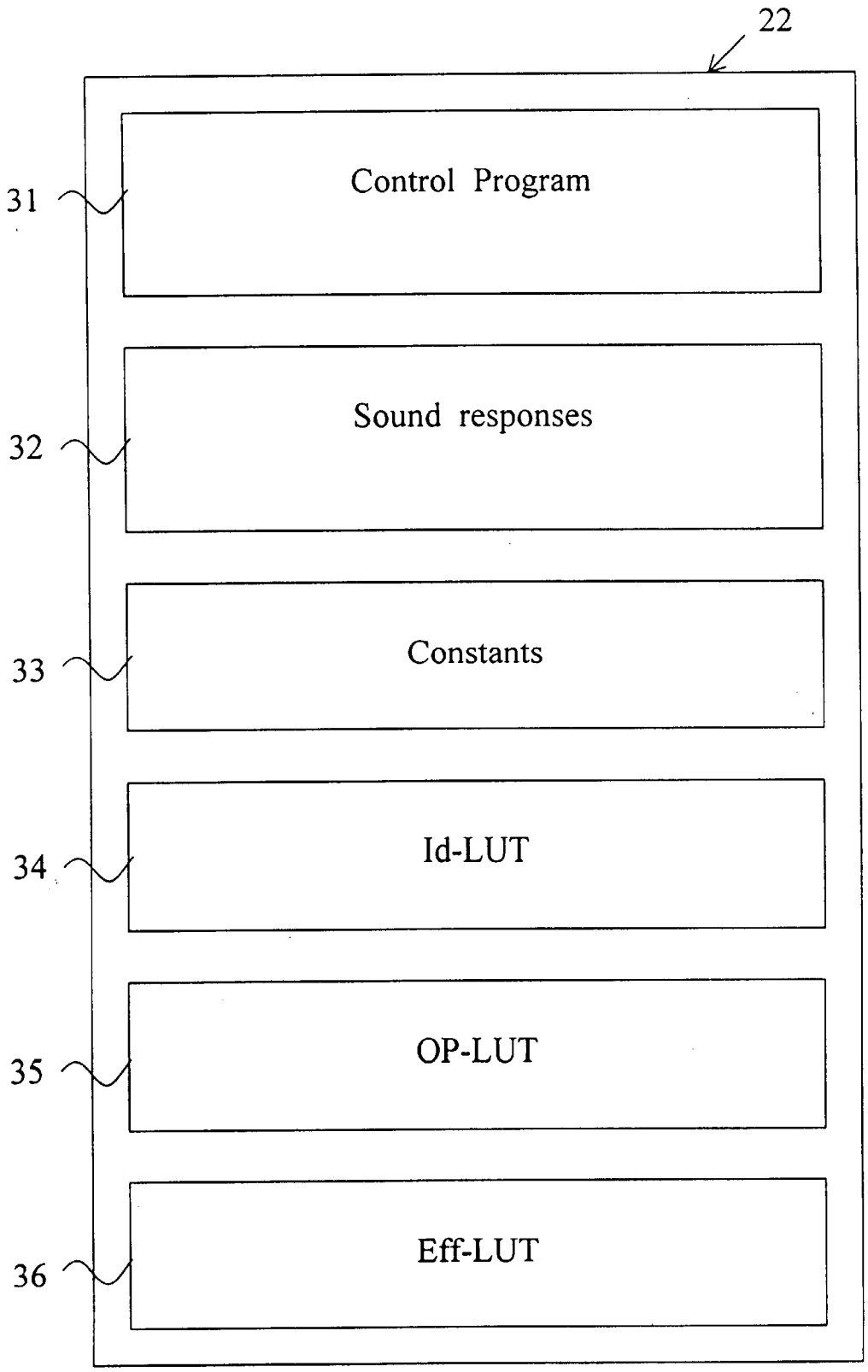
FIG. 3 shows areas of data in a read-only memory (ROM)

As it is shown in FIG. 3, ROM 22 consists of some areas, each of which has a special assignment. The program run by controller 21 is stored in control program area 31. This program is identical for all toys made according to the present invention.

As shown in FIG. 4, Sound Responses area 32 contains Address map 41 and Sound Programs area 42. Address map 41 contains starting addresses of sound response reproduction programs for all the possible couples of values of response type RType and response degree RDeg. As in the preferred embodiment of the present invention the number of such possible couples is equal to twelve, address table 41 contains twelve addresses of programs Adr1 . . . Adr12. Sound Programs area 42 contains sound responses reproduction programs. The amount of memory occupied by different programs can be different. Sound Program 1 is disposed in ROM 22 starting with address Adr1, Sound Program 2 is disposed in ROM 22 starting with address Adr2, etc.

Sound response reproduction programs are different for different types of toys. In each toy there are different sound response reproduction programs for different values of response type RType and response degree RDeg. Different RType and RDeg result in playing back sounds of different types, volume levels, timbres, etc.

Constants area 33 contains parameters describing the given toy during the interaction with other toys. The first of these parameters is ID identifier, which is unique for each type of toys according to the present invention. In the preferred embodiment, ID is a three-digit decimal number. ID is a part of each message transmitted by each toy for reception by another toy. As it will be described below, each toy "knows" beforehand identifiers of several other toys, thus these toys are familiar to it.

Further, Constants area 33 contains permanent parameters describing the given toy when it is interacting with other toys that "do not know" it in the above-mentioned sense. There are two such parameters in the considered embodiment: Size, describing dimensions or sizes, and Appearance, describing appearance. Parameter Size can have values 0—small, 1—it is smaller than medium, 2—medium, 3—large. Parameter Appearance can have values 0—terrible, 1—unpleasant, 2—pleasant, 3—beautiful. Parameters Size and Appearance are given to each type of toys and are a part of each message transmitted by the given toy for the reception by another toy.

Besides, Constants area 33 contains other parameters that define features of sound responses of the given toys type. Information about these parameters will be provided later when the programs are discussed.

Identificators Look-Up Table (Id-LUT) 34 contains identifiers ID of toys known to the first toy 1, and parameters that determine a response of the first toy 1 to every toy, known to it. Object Parameters Look-Up Table (OP-LUT) 35 contains parameters that define a response of the first toy 1 to a toy unknown to it, that is a toy, ID of which is not in Id-LUT 34, but this toy has sent its parameters of Size and Appearance to the first toy 1. Effect Look-Up Table (Eff-LUT) 36 contains parameters defining the response of the first toy 1 to the activation by the user.

Each of Id-LUT 34, OP-LUT 35, Eff-LUT 36 contains the values of four parameters: Rb—base value of the response type, Db—base value of a response degree, WR—bandwidth of random component values of the response type, WD—bandwidth of random component values of a response degree.

The response type is found by the following equation:

$$RType=\mathrm{Round}(Rb+(\mathrm{Random}(WR)-WR/2)/100), \quad (1)$$

where Random (X) is a function returning a random integer from interval (0, X), X is a positive integer, Round (Y) is a function returning an integer proximate to real argument Y. If in the result of calculation of equation (1), RType<0, then RType is assigned the value of 0, and if RType>3, then RType is assigned the value of 3.

The response degree is found by the following equation:

$$RDeg=\mathrm{Round}(Db+(\mathrm{Random}(WD)-WD/2)/100). \quad (2)$$

If in the result of calculation of equation (2), RDeg<0, then RDeg is assigned the value of 0, and if RDeg>3, then RDeg is assigned the value of 3.

FIG. 5 shows an example of table Id-LUT 34 in ROM 22 for the first toy 1. The Id-LUT 34 in the second toy 2 has the same structure, but its parameter values can be different. ID values of toys familiar to the first toy 1 are given in column ID. The number of rows in Id-LUT 34 can be different for different types of toys depending on the number of other toys types familiar for the toys of the given type. In columns Rb, Db, WR, WD the values of corresponding parameters are given. These values are used in equations (1) and (2) to compute the values of response type RType and response degree RDeg of the first toy 1, when the first toy 1 has received a message from the second toy 2, ID value of which is present in ID column.

FIG. 6 shows an example of table OP-LUT 35 in ROM 22 for the first toy 1. OP-LUT 35 in the second toy 2 has the same structure, but its parameter values can be different. In columns Size and Appearance there are Size and Appearance values accordingly. In the preferred embodiment of the present invention, the number of rows in table OP-LUT 35 is equal to 16. In columns Rb, Db, WR, WD parameter values Rb, Db, WR, WD accordingly are given. These values are used in equations (1) and (2) to compute the values of response type RType and response degree RDeg of the first toy 1, when it has received a message from the second toy 2, ID value of which is not given in ID column of Id-LUT 34 of the first toy 1.

FIG. 7 shows an example of table Eff-LUT 36 in ROM 22 for the first toy 1. Eff-LUT 36 in the second toy 2 has the same structure, but its parameter values can be different. In NSens column values of activation number are given. In the preferred embodiment of the present invention, NSens=1 corresponds to activation of sensor 7, and NSens=2 corresponds to activation of sensor 8. In columns Rb, Db, WR, WD values of the corresponding parameters are given. These values are used in equations (1) and (2) to compute values of response type RType and response degree RDeg of the first toy 1, when the user activates one of sensors 7, 8.

Further, the detailed description of the program run on controller 21 in the first toys 1 is considered. The program in the second toy 2 is the same as in the first toy 1, but the numerical parameters can be different. The following global variables will be used in the description of the main program and subroutines:

N is a counter of the main program cycle runs;

NM is a number of the main program cycle runs, without response reproduction between two reproductions of response;

NR is a counter of fulfilled reproductions of a sound response;

NRM is a number indicating how many times sound response reproduction is executed, before response degree decreases by a unity, when there is no interaction with another toy or the user;

NSens is a variable, that shows what sensor is activated by the user;

FR is a logic variable, which shows if there is a message received from the second toy 2 (FR=True), or there is no message from the second toy 2 (FR=False).

Figure 8:
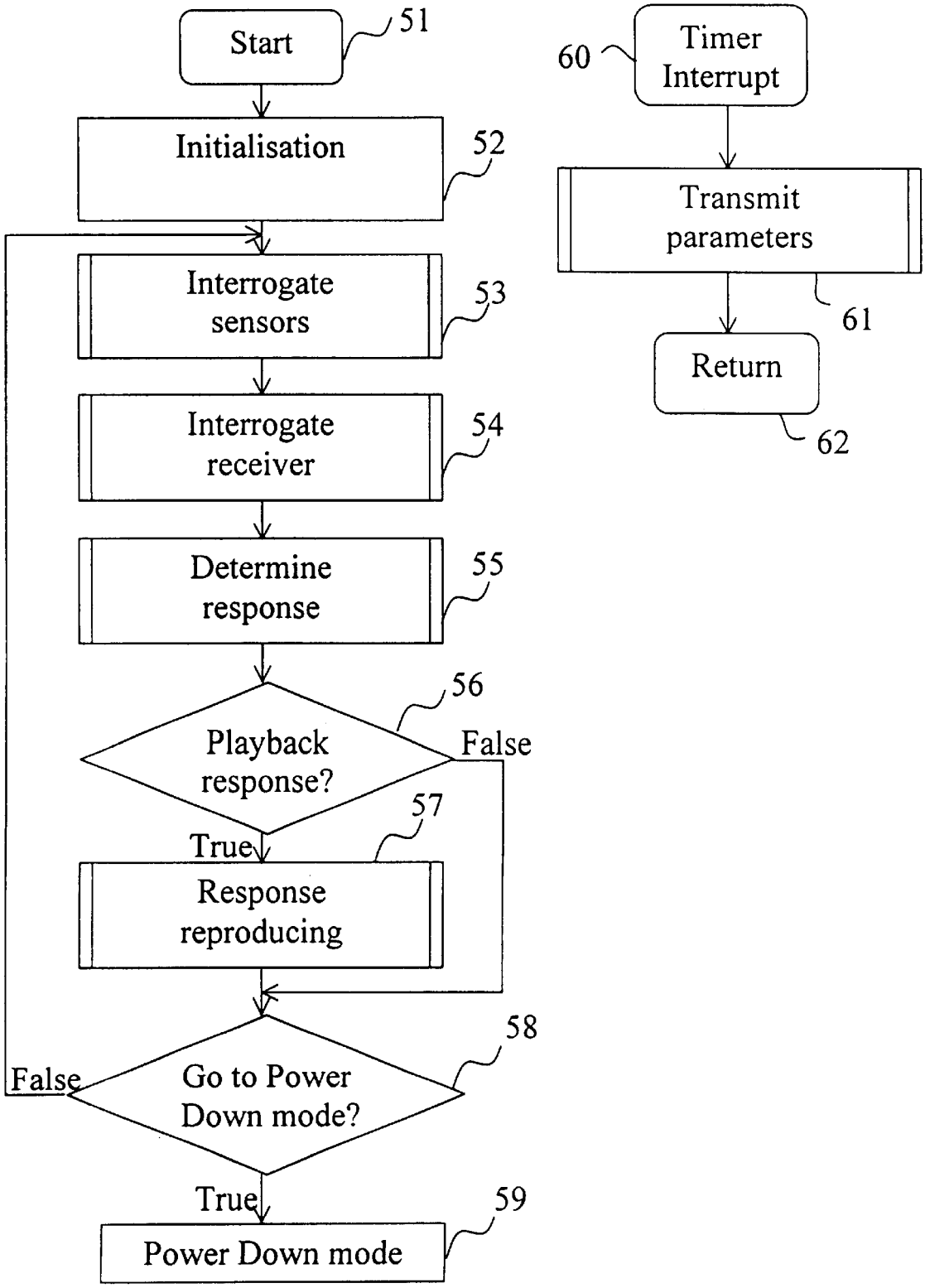
FIG. 8 shows a flowchart of a program executed by the controller in a toy.

As shown in FIG. 8, running of the program starts in block 51, when power is switched on or when signals are received simultaneously from both sensors 7, 8 via logic gate AND 28 to controller 21 Reset input. In block 52 the initialization of global variables is fulfilled: N=0, NM=0, NR=0, NRM=0, NSens=0, FR=False. In the same block, interruptions of the main program by timer 24 are enabled, and a value of the period of these interruptions is installed by loading of the corresponding number into timer 24.

Then, sensors interrogation subroutine 53, which determines value NSens, and receiver interrogation subroutine 54, which determines a value of logic variable FR are executed. After that response determination subroutine 55 is executed, that in accordance with found values NSens and FR determines a response type RType and a response degree RDeg for the response to be formed. Three above-mentioned subroutines will be described in detail below.

In logic block 56, the program determines, whether it is necessary to reproduce a sound response in the current run of the cycle. If the answer is positive, response forming subroutine 57 is executed. This subroutine finds out in Sound Responses area 32 in ROM 22 (FIG. 4) the address of the sound response reproducing program in accordance with the found values RType and RDeg and calls this subroutine. Programs of reproducing of sound responses are well known in the art, so there is no need to describe them.

In the opposite case, the program continues to logic block 58, in which it determines, whether it is time to go into Power Down Mode. This is done, if during a certain number of the main program cycles there was neither the user activation, nor reception of a message from the second toy 2. If in logic block 58 the answer "True" is obtained, in block 59 the program prohibits interruptions by timer 24, after this controller 21 goes to Power Down Mode, in which it will remain until the user activates both sensors 7, 8 simultaneously. If in logic block 58 the answer "False" is obtained, the program returns to the beginning of the cycle in block 53. Parallel to the described main program, the subroutine caused by interruptions from timer 24 is executed. The flowchart of this subroutine is shown on the right side of FIG. 8. This subroutine begins, when an interrupt signal from timer 24 is received (block 60). Then parameter transmitting subroutine 61 is executed. Controller 21 according to the predetermined transfer protocol sends to transmitting circuit 25 starting bits of a message, then ID value of the first toy 1, then Size and Appearance values of the first toy 1. After that, the interruption subroutine terminates (block 62). Thus, the first toy 1 transmits periodically with period TInt its parameters, so that the second toy 2 could receive them.

Figure 9:
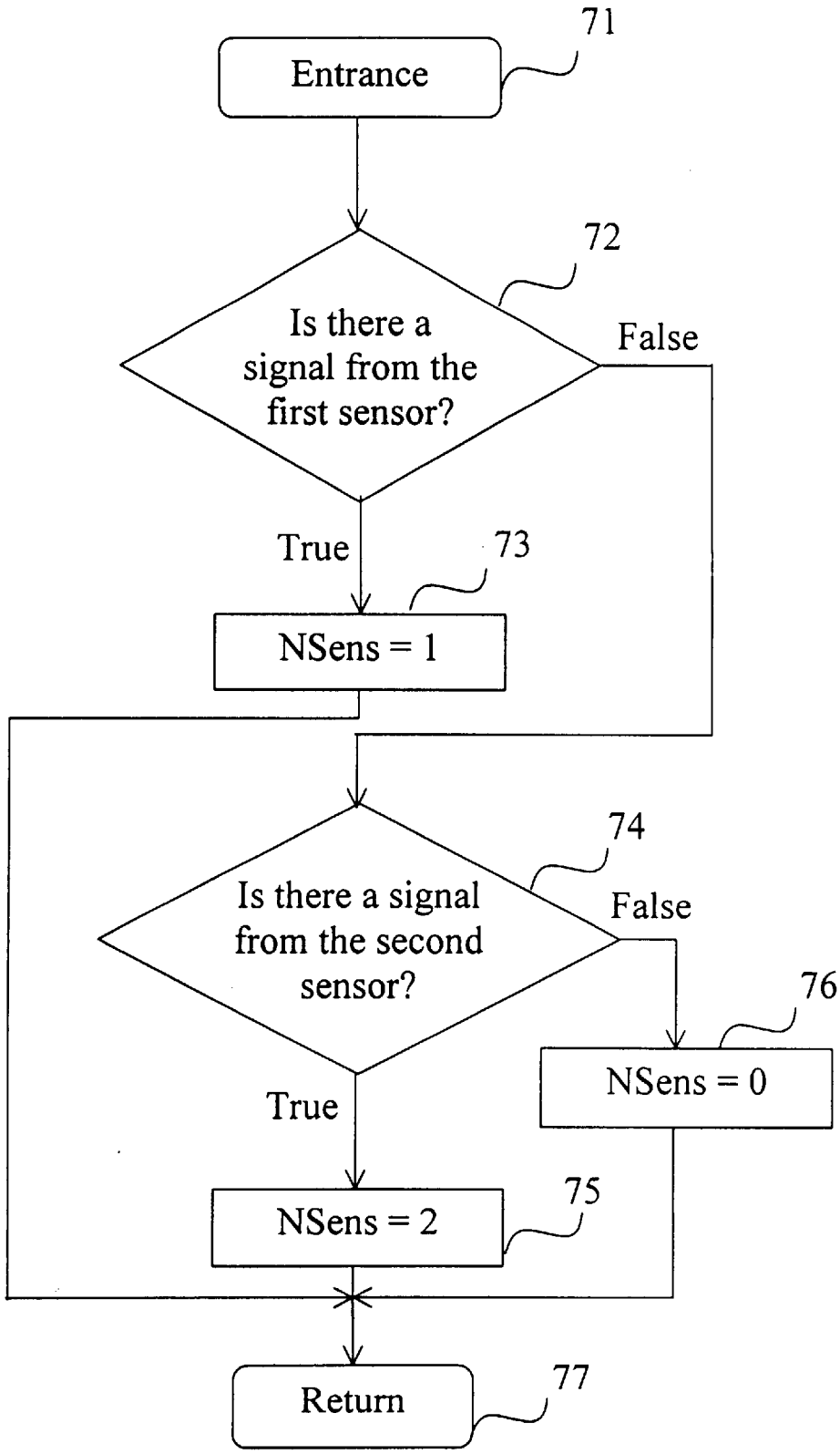
FIG. 9 shows a flowchart of a subroutine of sensors interrogation.

Further, we will describe flowcharts of subroutines called from the main program. As shown in FIG. 9, after entering subroutine of sensors interrogation 53 (block 71), controller 21 interrogates the first sensor 7 checking, if the user is activating this sensor (block 72). If the user is activating the first sensor 7, variable NSens gets the value of 1 (block 73), then subroutine 53 terminates in block 77. If the user does not activate the first sensor 7, controller 21 interrogates the second sensor 8 (block 74). If the second sensor 8 is activated, variable NSens gets the value of 2 (block 75), then subroutine 53 terminates in block 77. If the second sensor 8 is not activated, variable NSens gets the value of 0 (block 76), and subroutine 53 terminates in block 77.

Thus, as a result of execution of subroutine 53, variable NSens receives the value of 1 or 2, if the user is pressing sensor 7 or sensor 8 accordingly, or the value of 0, if the user does not press one of sensors 7, 8.

Figure 10:
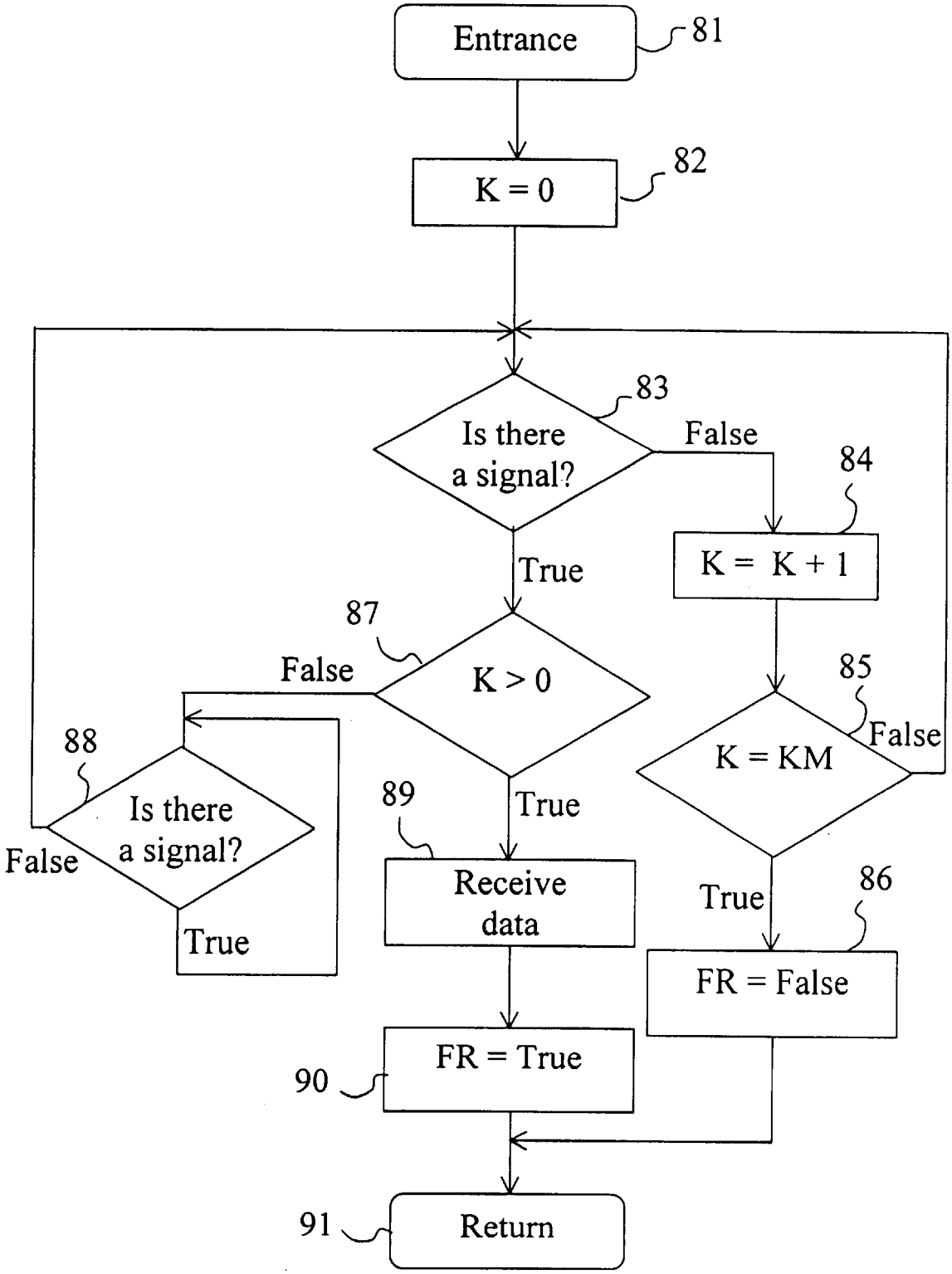
FIG. 10 shows a flowchart of a receiver interrogation subroutine.

FIG. 10 shows the flowchart of receiver interrogation subroutine 54, which interrogates receiving circuit 26. In this flowchart the following designations are used: K is a counter of loops of waiting for an output signal of receiving circuit 26; KM is a maximal number of loops of waiting for an output signal of receiving circuit 26.

After entering subroutine 54 (block 81) variable K gets the value of 0 (block 82). Then in logic block 83, the program checks if there are impulses on the output of receiving circuit 26. To do this, the program can, for example, check, if the voltage level on the output of receiving circuit 26 has changed during a given time interval. The detailed description of this procedure is not required, as such operations are well known, for example, they are used in remote control devices for signal reception. If impulses are not detected on the output of receiving circuit 26, it is concluded, that no message is received from the second toy 2, and the program continues to block 84, where value K increases by a unit.

Further, the program checks in logic block 85, whether the maximal number KM of loops of waiting for the output signal at receiving circuit 26 is reached. If this number is not reached yet, that is K<KM, the program returns to the beginning of the cycle of waiting to block 83. If K=KM, the cycle of waiting is terminated, logic variable FR gets value "False" (block 86), and subroutine 54 completes in block 91.

If checking in block 83 determines, that there are impulses on the output of receiving circuit 26, the program continues to logic block 87, in which it checks value K. If K=0, it means that the execution of receiver interrogation subroutine 54 started, when the message transmission by the second toy 2 has already began. In this case, the program continues to logic block 88, in which it waits for the message transmission to end, that is the absence of impulses at the output of receiving circuit 26. When the transmission of a current message is completed, the program returns to logic block 83 to begin the cycle of waiting for the transmission of the next message by the second toy 2. The waiting loop has already been described.

If checking in logic block 87 determines, that K>0, it means, that the message transmission by the second toy 2 has just began, as by the time impulses are detected, several loops of waiting cycle have been fulfilled. In this case the program continues to data reception subroutine 89. In duration of this subroutine, controller 21 reads data from the output of receiving circuit 26, selects from the received data the values of ID, Size and Appearance of the second toy 2, and saves these values in the corresponding variables in RAM 23. The detailed description of data reception subroutine 89 is not required, as such subroutines are well known, for example, in IR remote control devices.

Then, in block 90 logic variable FR receives value "True" that displays availability of the second toy 2 and successful reception of parameters transmitted by the second toy 2. Then, subroutine 54 terminates in block 91.

Figure 11:
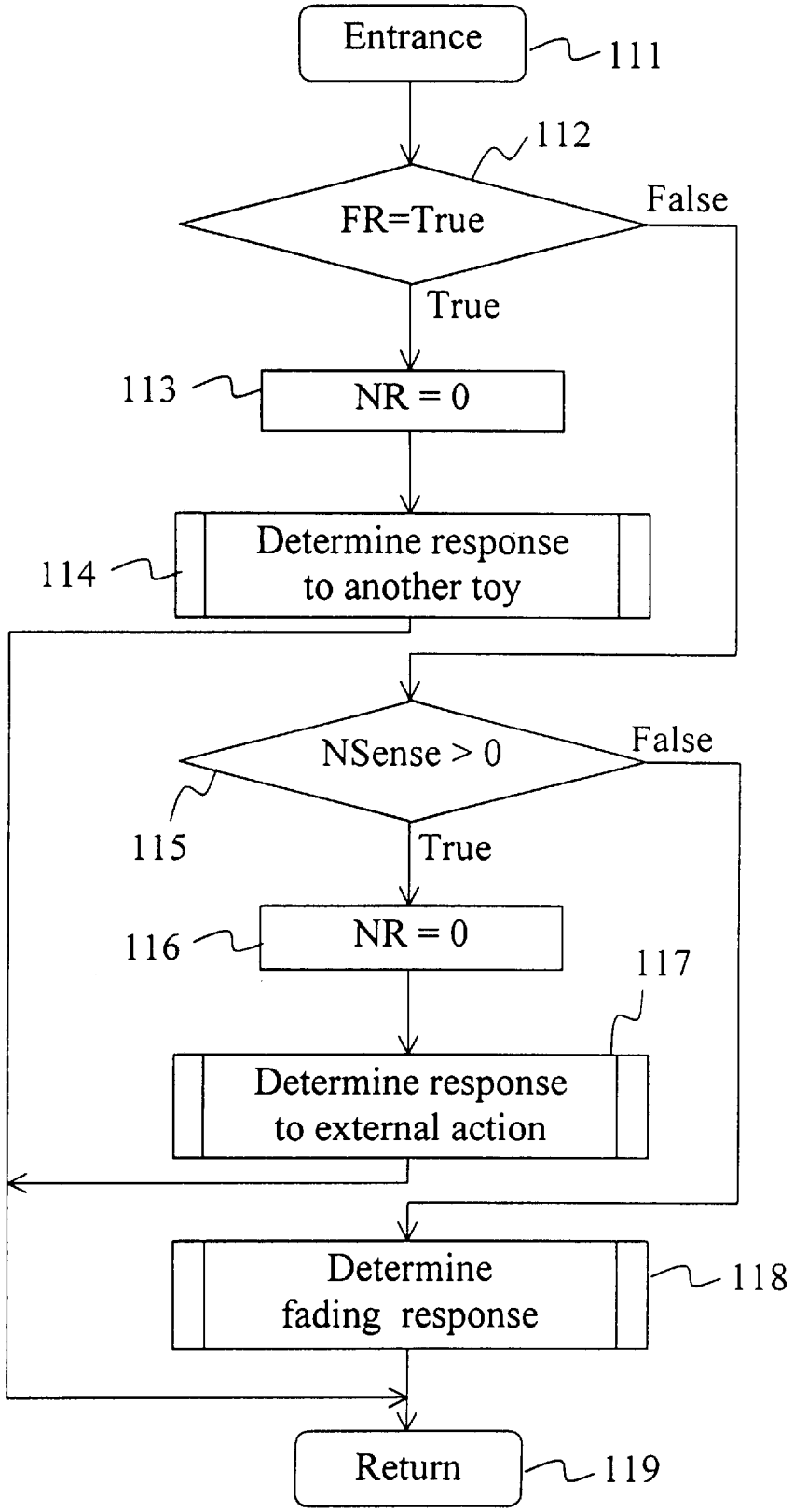
FIG. 11 shows a flowchart of a response determination subroutine.

FIG. 11 depicts the flowchart of response determining subroutine 55. After entering this subroutine in block 111, controller 21 checks logic variable FR (block 112). If FR is true, that is in subroutine 54 parameters of the second toy 2 were received, variable NR gets the value of 0 (block 113), then subroutine of determining response to another toy 1 14 is carried out, in which response type RType and response degree RDeg are determined. Then subroutine 55 terminates in block 119.

If FR is false, that is the second toy 2 is not present, the program continues to block 115, in which controller 21 checks value NSens. If NSens>0, that is the activation by the user of one of sensors 7, 8 is detected, then variable NR gets the value of 0 (block 116). After that, subroutine of determining response to an external action 117 is fulfilled, in which response type RType and response degree RDeg are determined. Then subroutine 55 terminates in block 119.

If NSens=0, that is the user is not activating sensors 7, 8, subroutine of determining a fading response 118 is carried out, in which response type RType and response degree RDeg for the fading response are determined. Then subroutine 55 terminates in block 119.

As it follows from the description of subroutine 55, the availability of the second toy 2 has the priority over the activation by the user of sensors 7, 8. If there is the second toy 2 available, that is FR is true, the type and degree of response are determined in subroutine 114, and the activation by the user of sensors 7 or 8 is ignored. The variable NR, as it will be shown later, will be used for determination of the response fading when there is no other toy available and the user does not interact with the given toy. If there is the second toy 2 or the user activation, variable NR is set to zero in blocks 113 or 116 accordingly.

Figure 12:
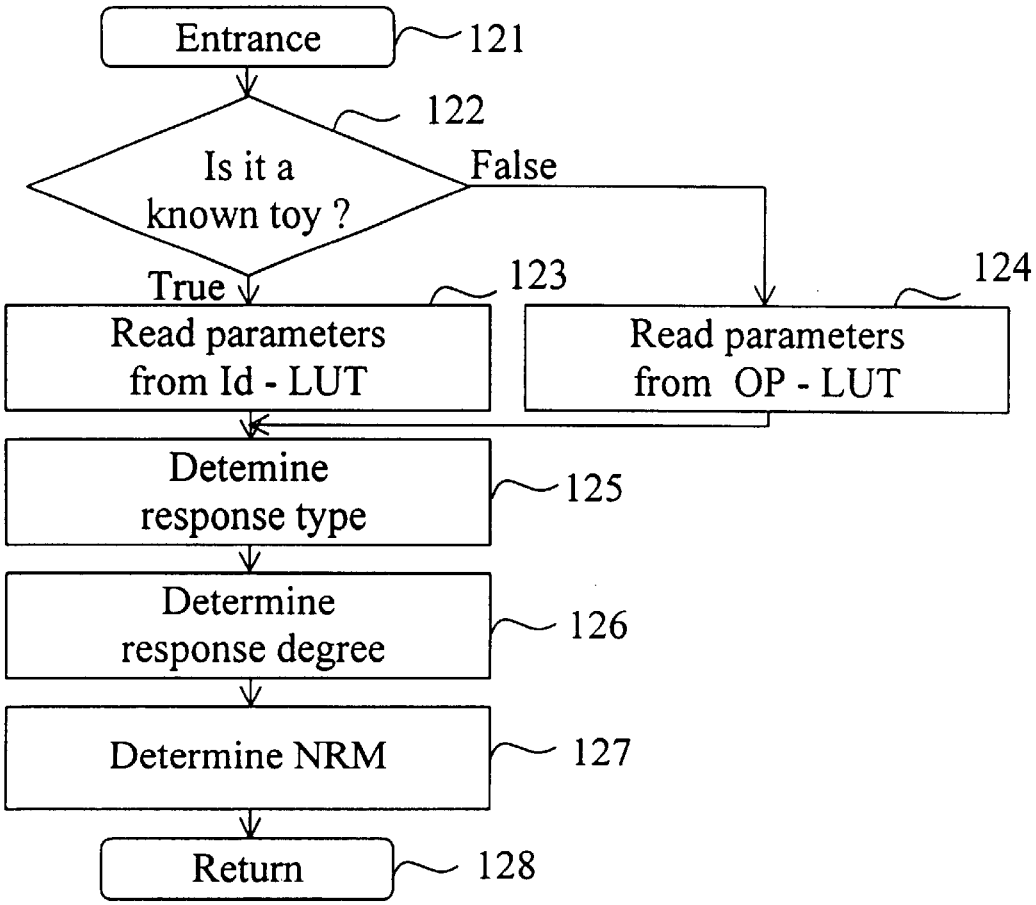
FIG. 12 shows a flowchart of a subroutine of determination of a response to the presence of another toy.

FIG. 12 shows the flowchart of subroutine of determining a response to another toy 114. After entering this subroutine in block 121, controller 21 checks in logic block 122, whether the second toy 2 is known to the first toy 1. To do so, controller 21 sequentially compares ID value received from the second toy 2 with values of all identifiers in ID column in Id-LUT 34 in ROM 22. If there is a value of identifier coinciding with the received ID value in Id-LUT 34, logic block 122 gives the answer "True", that is the second toy 2 is familiar to the first toy 1. In this case, the program continues to block 123, in which controller 21 reads parameters Rb, Db, WR and WD (their meaning was explained above) from Id-LUT 34 row containing a required identifier.

If in Id-LUT 34 there is no identifier value coinciding with the received ID value, logic block 122 gives the answer "False", that is the second toy 2 is not familiar. In this case, the program continues to block 124, in which controller 21 finds in OP-LUT 35 in ROM 22 a row corresponding to received Size and Appearance parameters of the second toy 2, and reads parameters Rb, Db, WR and WD from the row found in OP-LUT 35.

Then, in both mentioned cases, controller 21, in accordance with read values Rb, Db, WR and WD, using equation (1) calculates the value of response type RType (block 125) and using equation (2) calculates the value of response degree RDeg (block 126). The operations executed in blocks 125 and 126 were fully explained when equations (1) and (2) were considered.

Next, controller 21 in block 127 computes value NRM, that, as it was explained earlier, displays the number of sound responses before lowering response degree by a unit, when there is no interaction either with the second toy 2 or with the user. In the preferred embodiment of the present invention, value NRM is calculated by the following equation:

$$NRM = NRMb + \mathrm{Random}(WNRM), \tag{3}$$

where NRMb is a base value of NRM; WNRM is a bandwidth of a random component of NRM. Values NRMb and WNRM characterize fading rate of the toy response. The process of response fading will be described later in detail. Values NRMb and WNRM for the first toy 1 are stored in Constants area 33 in ROM 22 of the first toy 1.

After calculation of NRM, the subroutine terminates in block 128.

Figure 13:
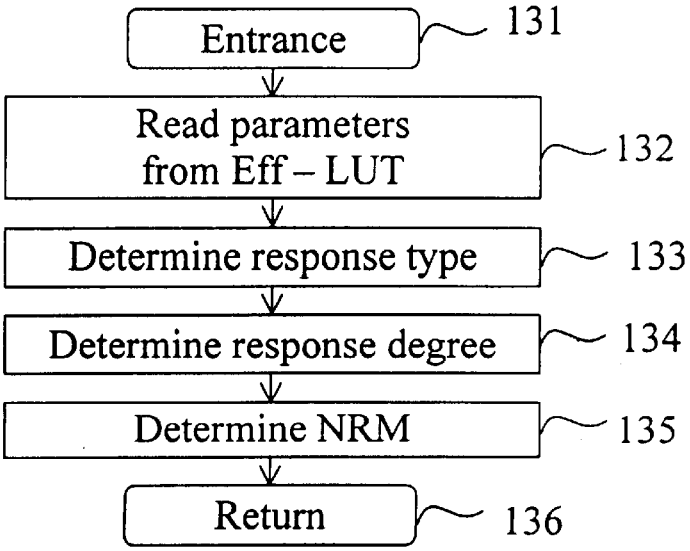
FIG. 13 shows a flowchart of a subroutine of determination of a response to an external action.

FIG. 13 shows the flowchart of subroutine of determining response to external effect 117. After entering this subroutine in block 131, controller 21 finds out in Eff-LUT 36 in ROM 22 the row corresponding to NSens value calculated before, that is corresponding to a sensor activated by the user, and reads from this row parameters Rb, Db, WR and WD (block 132). Then, controller 21 with the help of read values Rb, Db, WR and WD, using the equation (1) calculates the value of response type RType (block 133), using equation (2) calculates the value of response degree RDeg (block 134) and using equation (3) calculates values NRM (block 135). All these calculations are done in the same way as in subroutine 114 described before. Then, subroutine 117 terminates in block 136.

Figure 14:
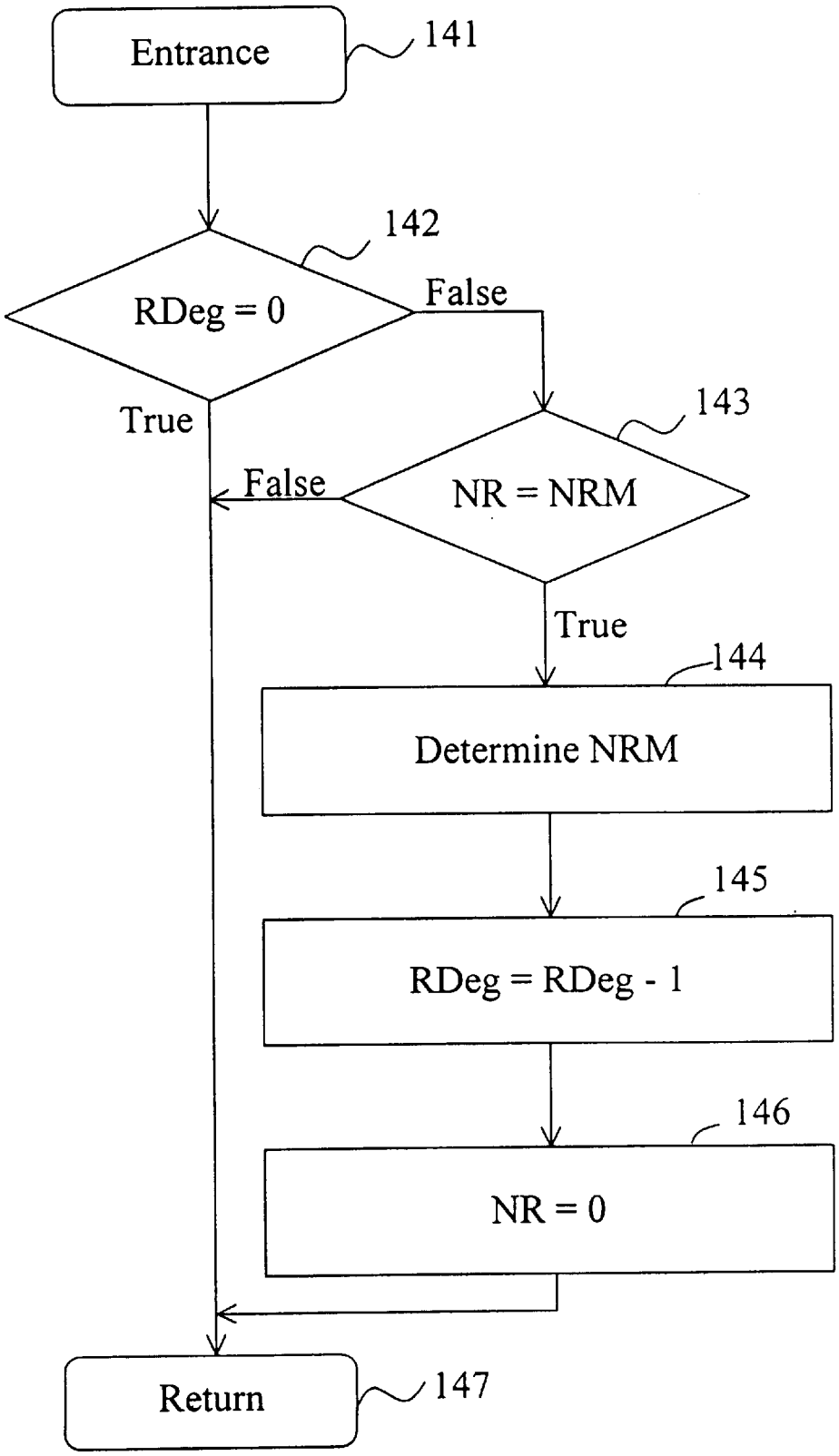
FIG. 14 shows a flowchart of a subroutine of determination of a response in the absence of other toys and external actions.

FIG. 14 shows the flowchart of response fading determining subroutine 118. After entering this subroutine in block 141, controller 21 checks a current value of response degree RDeg (block 142). If RDeg=0, subroutine 118 immediately terminates in block 147. In this case, the response degree of the toy is already equal to zero, and its further reduction is impossible.

If in block 142 it is found out, that RDeg>0, the program continues to block 143, in which it checks, whether variable NR has reached value NRM. If the answer to this question is negative, that is NR<NRM, subroutine 118 terminates in block 147. In this case response degree RDeg of the toy does not change, as NRM of response reproductions has not been fulfilled yet.

If in block 143 it is found out, that NR=NRM, block 144 is executed, in which controller 21 using equation (3) calculates a new value NRM. Then, the value of response degree RDeg decreases by a unit (block 145), variable NR gets the value of 0 (block 146), and subroutine 118 terminates in block 147.

Thus, if the first toy 1 in the result of receiving data from the second toy 2 or in the result of the activation by the user has transferred into the condition characterized by response type RType and response degree RDeg, and then there are no messages transmitted by the second toy 2 or no activation by the user for a sufficiently long time, the degree of response RDeg gradually decreases, until it becomes equal to zero. As it was explained, when equation (3) was described, parameters NRMb and WNRM are set for each toy by recording in Constants area 33 in ROM 22. There can be toys with a response fading fast and with a response fading slowly that allows to imitate different temperaments of the characters represented by the toys. Availability of a random component in equation (3) diversifies behavior of the toy.

Figure 15:
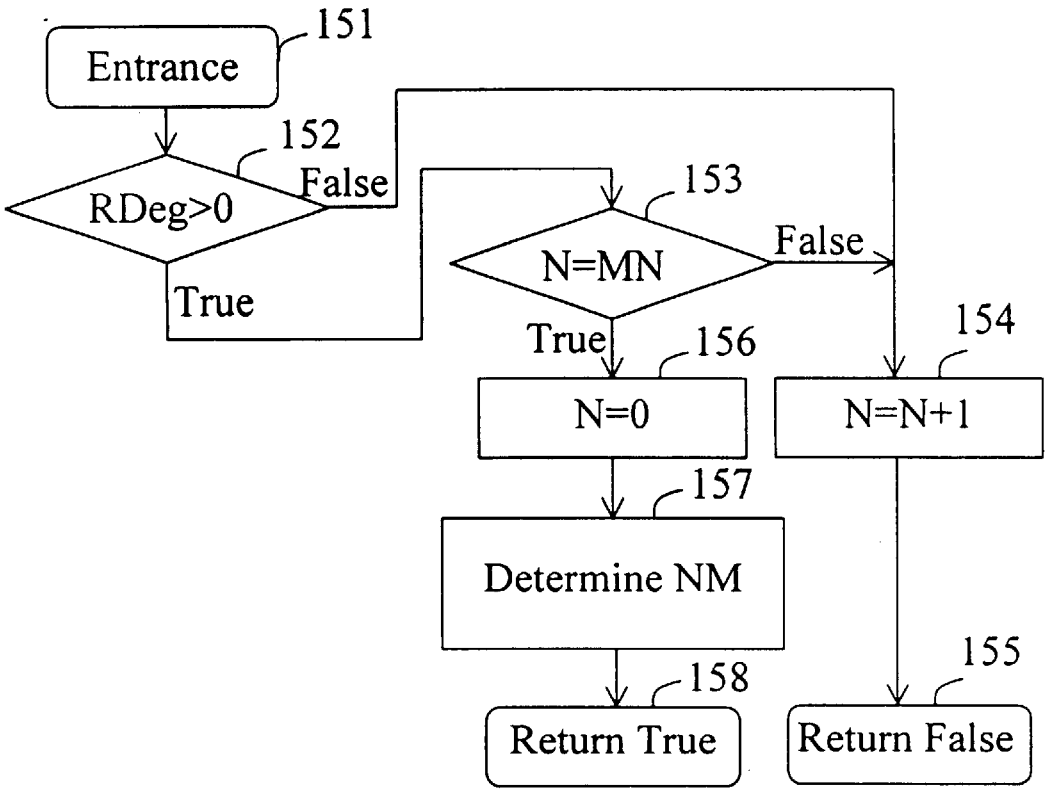
FIG. 15 shows a flowchart of a subroutine of testing a condition for the beginning of response forming.

FIG. 15 shows the flowchart of subroutine 56 that defines whether it is necessary to reproduce a response in the current loop of the main program cycle. After entering this subroutine in block 151, controller 21 checks a current value of response degree RDeg. If checking in logic block 152 gives the negative answer, that is RDeg=0, the program continues to block 154, in which value N is increased by a unit. Then, in block 155, subroutine 56 returns the logic value "False" and terminates.

If checking in block 152 gives the positive answer, that is RDeg>0, the program continues to block 153, in which it compares a current value N with value NM, which reflects a number of the main program cycles executed without response reproduction. If in block 153 it is found out, that N<NM, that is it is early to play back the response, the program continues to block 154, in which value N increases by a unit. Then, in block 155, subroutine 56 returns the logic value "False" and terminates.

If it was found out that N=NM, then the program continues to block 156, in which variable N gets the value of 0. Then in block 157, controller 21 calculates a new value NM, then subroutine 56 returns the logic value "True" and terminates in block 158. After that, subroutine 57 of response reproducing is executed, in which value NR is increased by a unit.

In the preferred embodiment of the present invention, value NM is found according to the following equation:

$$NM=(NMb+\mathrm{Random}(WNM))*(4-R\mathrm{Deg}), \quad (4)$$

where NMb is base value NM; WNM is a bandwidth of a random component of NM. Values NMb and WNM characterize frequency of repetitions of response reproduction by the first toy 1 to the presence of the second toy 2 and to the activation by the user. Values NMb and WNM for the first toy 1 are stored in Constants area 33 in ROM 22. The factor (4−RDeg) reflects the influence of the current value of response degree RDeg on the frequency of repetitions of response reproductions. The higher the value RDeg, that is the higher the intensity of the response, the less the above-mentioned factor and, therefore, the less the value NM, that is responses are played back more often. Thus, the frequency of response reproductions is one of characteristics of this response intensity.

The availability of a random component in equation (4) provides additional diversity of the toy behavior, as value NM is computed separately for each interval between response reproductions, and these intervals can change randomly.

Figure 16:
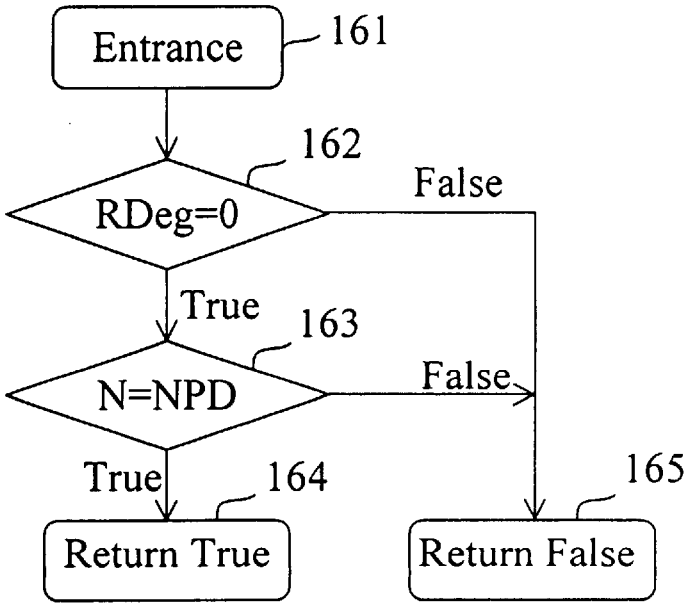
FIG. 16 shows a flowchart of a subroutine of testing a condition for transition to Power Down mode.

FIG. 16 shows the flowchart of subroutine 58, which determines, whether it is necessary to pass to Power Down Mode. In this subroutine constant NPD will be used to define how many runs of the main program should be fulfilled starting with setting during response fading to RDeg=0 and till transition to Power Down Mode. Value NPD is stored in Constants area 33 in ROM 22.

After entering subroutine 58 in block 161, controller 21 checks the current value of response degree RDeg (block 162). If RDeg>0, then the subroutine returns logic value "False" and terminates in block 165, because if the toy has a nonzero response degree, transition to Power Down Mode cannot take place.

If checking in block 162 shows, that RDeg=0, controller 21 in block 163 compares the current value N with constant NPD. If this checking determines that N<NPD, that is it is still early to pass to Power Down Mode, the program continues to block 165, in which it returns logic value "False" and terminates. If it is found out in block 163, that N=NPD, that is it is time to pass to Power Down Mode, the subroutine passes to block 164, in which it returns the logic value "True" and terminates.

As it follows from the explanation of the last two subroutines, the counter of cycle runs N is first used for control of reproducing of the toy response, and when the response has faded to zero, it is used to determine a moment of transition to Power Down Mode.

Herein we have described the program for the first toy 1. It is clear, that the program for any other interacting toy according to the present invention is created in the similar way, but numerical parameters can be different.

Thus, in devices according to the preferred embodiment of the present invention the possibility is ensured to change both, sound responses and time intervals between separate responses reproductions, that makes behavior of toys manifold and more interesting to the user.

Conclusion, Ramifications and Scope

As it is clear from the description of the preferred embodiment of the present invention, this invention provides new possibilities and advantages over toys reacting to external activation known before. These new possibilities and advantages are possible because the toys according to the present invention can recognize one another and react to each other in different ways.

Each toy according to the present invention periodically transmits messages containing information about this toy. Another toy receives these messages and reacts to them according to the information received. Different types of responses imitate personalities of characters represented by toys, their mutual sympathies and antipathies. Each toy can have individuality and its own way to react to other toys. If there are more than two toys, different pairs of toys establish different variants of reciprocal reactions. In result, there will be a community of interacting toys, that creates absolutely new possibilities of cognitive, pedagogic and entertainment impact on children. This community can be enlarged by introducing new toys, and thus getting new variants of behavior and mutual relations among toys.

The responses of the present invention toys to other toys of the kind and to the activation by the user differ in types and in intensity degrees. It creates vast possibilities to vary individuality of toys and variants of their behavior when they meet. The gradual fading of the toy response after removal of another toy or after the termination of the user interaction with the toy makes toys behavior more natural.

Another advantage of toys according to the given invention is that the response of one toy to another or to the activation by the user is only partially determined. The influence of a random factor on selection of a response type and on its intensity degree brings in more diversity in toys behavior and makes playing with them even more interesting and instructive.

Toys with different responses sets imitating different characters and personalities can have identical electronic blocks and differ only by data recorded during programming. The unification of electronic blocks allows to reduce toys production costs.

Another advantage of the toys according to the present invention is that the consumer can extend a community of toys available for him/her, introducing new members into it, or purchasing such toys by subject sets, for example, sets of characters of any popular fairy tale, or sets of tropical animals. At the same time, manufacturers of toys can produce new toys, that will interact among themselves, as well as with toys manufactured earlier. Due to this, the interest of Consumers to interacting toys and, therefore, the demand for such toys will be permanently supported.

Although the description above contains many specificities, these should not be construed as limiting the scope of the invention but as merely providing illustrations of the presently preferred embodiment of this invention. Many other embodiments are possible. Some of these variants are discussed below.

Message transmission from one toy to another using IR rays was described above as an example. Radio communication can be used as an alternative message transmission method. In this case, it is. possible to make use of any known technique, for example, as in cordless telephones. Messages can also be transmitted by the way of audible tones or ultrasonic signals. For each message transmission method any suitable message format and antijamming coding method can be used.

The amount of sensors in the toy according to the present invention can be different. Their layout can be different, too. Sensors can react not only to pressing by the user, but also to sounds (claps, whistles etc.), to turning the light on and off, to approaching of a person and other external events. Sensors of different types of external actions are well known in the art.

Response types and response degrees are given in the description of the invention as examples. The number of response types and response degrees and the characteristics of these parameters can be different. Besides, they can be different for different toys. There can be responses such as, for example, curiosity, invitation to play together, giving in to a partner or the demand to take control over a partner, etc.

Other variants of dependencies of responses on time are also possible. For example, if the presence of another toy is detected, the response degree can first rise with time and then fade. Furthermore, the dependence of the response degree on time can be different depending on what other toy is detected. The type of dependence of the response degree on time can be selected randomly to make behavior of the toy more manifold and interesting.

Messages transmitted by the toy, can contain not only its ID identifier and Size and Appearance parameters, as it is described in the preferred embodiment of the present invention, but also other data, which can affect interaction among toys, for example, color, presence and type of coat, presence of a tail and its length, etc. The principles of determining the toy response to these parameters will be the same, as described in the preferred embodiment of the present invention. It is only necessary to increase the size of OP-LUT table and include additional toy parameters in it.

Data transmitted by each toy, can include not only its static parameters, such as Size and Appearance, but also values of response type RType and response degree RDeg, that describe the current emotional condition of the toy. In this case, the response of the toy, which has received a message can depend on the current condition of the toy, which has transmitted this message. For this purpose, it is necessary to enter appropriate data into Id-LUT and OP-LUT tables. Cross-influence of conditions of interacting toys in combination with different condition dependencies on time and with random components in equations (1) and (2) will make a huge range of variants of development in time of toys responses to each other.

Responses of the toy to the presence of another toy and to the activation by the user can be expressed not only by sounds, but also by motions of any parts of the toy, for example, hands, by light signals, for example, luminescence of an eye, by displaying of text or digits on LCD, and by other possible ways.

The transition of controller 21 into Power Down Mode available in the preferred embodiment of the present invention is optional. The variants are possible, in which the toy is in active state and can perceive messages from other toys all the time, while the power supply is switched on. In such variants, sensors sensing the activation by the user, can be excluded, and, for example a power switch can be used instead. The toys of such embodiment will respond only to the presence of the other toy. Thus, among toys available for consumers, there can be both, toys with sensors of the activation by the user, and toys without such sensors, and all these toys will interact among themselves.

Thus, the present invention provides ample possibilities for creation of manifold and interesting interactions between toys, for creation of community of toys living a life independent of the person.

Having described the preferred embodiment of the invention with reference to the accompanying drawings, it is to be understood that the invention is not limited to this precise embodiment, and that various changes and modifications may be effected therein by one skilled in the art without departing from the scope or spirit of the invention as defined in the appended claims.

I claim:

1. Interacting toys consisting of at least a first toy and a second toy, each of which comprises a housing defining the shape and appearance of the toys;

wherein at least said second toy comprises transmitting means for transmitting at least one message with information describing said second toy therein; and wherein at least said first toy comprises:

reproducing means for reproducing of responses of said first toy;

storage means for storing data providing reproduction of responses that imitate various emotional conditions of the character represented by said first toy;

message receiving means for receiving said at least one message; and control means connected to said reproducing means, to said storage means and to said receiving means, being operative to select said information describing said second toy from said at least one message, in accordance with said information describing said second toy to determine at least one first number corresponding to a first emotional condition of the character represented by said first toy, in accordance with said at least one first number to read from said storage means first data providing the reproduction of at least one first response imitating said first emotional condition of the character represented by said first toy, and to transmit said first data to said reproducing means for reproduction of said at least one first response.

2. The interacting toys of claim 1, wherein said control means is operative after termination of receiving of messages transmitted by said second toy, at least once to determine at least one second number corresponding to a second emotional condition of the character represented by said first toy, in accordance with said at least one second number to read from said storage means second data providing the reproduction of at least one response imitating said second emotional condition of the character represented by said first toy, and to transmit said second data to said reproducing means for reproducing of said at least one response.

3. The interacting toys of claim 2, wherein said second emotional condition is of the same type as said first emotional condition and has a lower intensity level than said first emotional condition.

4. The interacting toys of claim 1, wherein at least said first toy further comprises at least one sensor for responding to external actions different from the message transmission by said second toy; and wherein said control means is connected with said at least one sensor being operative in reply to a signal from said at least one sensor to determine at least one third number corresponding to a third emotional condition of the character represented by said first toy, in accordance with said at least one third number to read from said storage means third data providing the reproduction of at least one second response imitating said third emotional condition of the character represented by said first toy, and to transmit said third data to said reproducing means for reproduction of said at least one second response.

5. The interacting toys of claim 4, wherein said control means are operative after the termination of said external action to determine at least one forth number corresponding to a forth emotional condition of the character represented by said first toy, in accordance with said at least one forth number to read from said storage means forth data providing the reproduction of at least one response imitating said forth emotional condition of the character represented by said first toy, and to transmit said forth data to said reproducing means for reproduction of s aid at least one response.

6. The interacting toys of claim 5, wherein said forth emotional condition is of the same type as said third emotional condition and has a lower intensity level than said third emotional condition.

7. The interacting toys of claim 4, wherein said at least one sensor is a touch sensor.

8. The interacting toys of claim 1, wherein said transmitting means includes means of transmitting an optical signal, and wherein said receiving means includes means of reception of an optical signal.

9. The interacting toys of claim 1, wherein said transmitting means includes a radio-transmitter; and wherein said receiving means includes a radio receiver.

10. The interacting toys of claim 1, wherein said reproducing means includes sound reproducing means.

11. The interacting toys of claim 1, wherein said information describing said second toy contains at least an identifier uniquely defining the character represented by said second toy, or data describing appearance of said second toy, or data describing an emotional condition of the character represented by said second toy.

12. The interacting toys of claim 1, wherein said transmitting means is operative to repeate the message transmission with a predetermined time interval.

13. A system of interacting toys consisting of at least two toys, each of which comprises:

a housing defining its shape and appearance;

reproducing means for reproducing of responses of the toy;

storage means for storing data that provides the reproducing of responses;

transmitting means for transmitting of at least one first message including data characterizing the character represented by said toy;

receiving means for receiving of at least one second message transmitted by another toy of said system of interacting toys; and control means connected with said reproducing means, with said storage means and with said receiving means, being operative to select from said second message data characterizing the character represented by said other toy, according to said data characterizing the character represented by said other toy to read from said storage means data about at least one response, and to transmit said data about said at least one response to said reproducing means for reproduction of said at least one response.

14. The system of interacting toys of claim 13, wherein said at least one response imitates an emotional condition of the character represented by said toy generated by meeting of the character represented by said other toy.

15. The system of interacting toys of claim 13, wherein said at least one response is an audible message.

16. A method of toys interaction comprising steps of:

providing of at least a first toy and a second toy, wherein at least said second toy comprises message transmitting means, and wherein at least said first toy comprises message receiving means, responses reproducing means, and storage means containing data about responses of said first toy, that imitate various emotional conditions of the character represented by said first toy;

transmitting by said second toy of at least one message;

receiving of said at least one message by said first toy;

determining according to said at least one message at least one first number corresponding to an emotional condition of the character represented by said first toy;

selecting in said storage means according with said at least one first number data about at least one response imitating said emotional condition;

reproducing of said at least one response by said reproducing means of said first toy.

17. The method of toys interaction of claim 16, wherein said at least one message contains at least an identifier uniquely defining the character represented by said second toy, or data describing appearance of said second toy, or data describing an emotional condition of the character represented by said second toy.

18. The method of toys interaction of claim 16, wherein said selecting of data in said storage means is carried out according to at least one second number characterizing the individuality of the character represented by said first toy.

19. The method of toys interaction of claim 16, wherein said transmitting of at least one message by said second toy and said receiving of said at least one message by said first toy are repeated periodically.

* * * * *